US006305985B1

(12) United States Patent
Akiha

(10) Patent No.: US 6,305,985 B1
(45) Date of Patent: Oct. 23, 2001

(54) CONNECTOR PROVIDED WITH ELECTROMAGNETIC SHIELD, METHOD OF MANUFACTURING THE CONNECTOR AND APPARATUS USED FOR THE METHOD

(75) Inventor: Yoshinobu Akiha, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/453,899

(22) Filed: Mar. 28, 2000

(30) Foreign Application Priority Data

Mar. 30, 1999 (JP) ..... 11-089347

(51) Int. Cl.[7] ..... H01R 13/648
(52) U.S. Cl. ..... 439/607; 428/411.1
(58) Field of Search ..... 428/411.1, 209, 428/323–8, 446–57; 252/521; 427/96

(56) References Cited

U.S. PATENT DOCUMENTS 5,082,732 * 1/1992 Vaugh ..... 428/411.1
5,879,807 * 3/1999 Inoue et al. ..... 428/408
5,938,979 * 8/1999 Kambe et al. ..... 252/500
6,157,548 * 3/1999 Collins et al. ..... 361/818

FOREIGN PATENT DOCUMENTS 6-204683 * 6/1984 (JP) .
A 8-298168 11/1996 (JP) .
A 10-144406 5/1998 (JP) .
2000-13953 * 1/2000 (JP) .

OTHER PUBLICATIONS

Endo et al., "Preparation and Applications of Carbon Film Obtained by Pulse–Laser Irradiation to Polyimide", *I.E.E. Journal,* vol. 117–A, No. 6, pp. 638–644 (1997). (No Month).

* cited by examiner

*Primary Examiner*—Lincoln Donovan
(74) *Attorney, Agent, or Firm*—Sughrue, Mion, Zinn, Macpeak & Seas, PLLC

(57) ABSTRACT

To provide a connector with an electromagnetic shield capable of easily providing an electromagnetic shield layer on the surface of a connector housing with a homogeneous thickness even in the case the connector housing has a complicated structure with many projections and recesses so as to obtain the excellent electromagnetic shield effect without increase of the number of the connector components or increase of the weight, and a manufacturing method and an apparatus therefor. An electromagnetic shield layer is formed on the surface of a connector housing made from a graphitizable material having the insulation property, by graphitization of the material by irradiating the surface of the connector housing with a laser beam in an inert gas atmosphere.

4 Claims, 3 Drawing Sheets

CONNECTOR PROVIDED WITH ELECTROMAGNETIC SHIELD, METHOD OF MANUFACTURING THE CONNECTOR AND APPARATUS USED FOR THE METHOD

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

Description of Related Art

Recently, according to the trend toward electric automobiles or hybridization of automobiles and multiplexing of electric signals for controlling electric and electronic devices mounted in automobiles, an electromagnetic shield technique is strongly desired for various kinds of electric wires and connectors comprising a wire harness to serve as a cable way.

In the case of the connectors, the shield effect with respect to electromagnetic waves is required for both preventing radiation of the electromagnetic waves from a terminal accommodated in a connector housing to the outside and preventing influence on an electric signal in a terminal in a connector housing from the outside electromagnetic waves.

In order to meet such demands, various proposals have been provided.

For example, Japanese Patent Publication No. 10-144406A discloses a method for providing a shield effect with conductive material powders by introducing powders of a conductive material having the excellent absorbing property with respect to electromagnetic waves, such as ferrite into the outer wall of a resin connector housing or a resin cover for covering the periphery of the connector housing.

Moreover, Japanese Patent Publication No. 8-298168A discloses a method for providing a desired shield effect with an electromagnetic blocking plate by providing an electromagnetic blocking plate comprising a metal plate in a resin connector housing or on the outer surface thereof.

Furthermore, a method for providing a desired shield effect with a conductive thin film by providing a conductive thin film on the outer surface of a resin connector housing by applying electroless plating or a conductive coating is proposed.

However, the method of introducing conductive material powders into a resin connector housing or cover arises a problem in that there is a risk of partially producing a portion having a low shield effect unless the conductive material powders are dispersed homogeneously and with an appropriate concentration in the resin material and thus it is difficult to obtain a stable shield performance. Moreover, since a step of mixing and agitating the conductive material powders in the resin material is required, problems of the material cost rise and the connector cost rise due to complication of the connector forming process are involved.

Further, the method of providing a shield effect with the electromagnetic blocking plate comprising a metal plate arises a problem in that the weight of the connector is increased due to the weight of the metal plate. Moreover, a problem of drastic cost rise of the connector due to increase of the number of components of the connector is involved.

Further, the method of providing the shield effect with the conductive thin film formed by application of electroless plating or a conductive coating arises a problem in that the film thickness of the formed conductive thin film tends to be irregular in the case the connector housing has a complicated structure with many projections and recesses so that there is a risk of partially producing a portion having a low shield effect due to the film thickness irregularity, and thus it is difficult to obtain a stable shield performance. Moreover, since the forming process of the conductive thin film is required as a formation step of the connector and the material cost of the conductive thin film is needed, a problem of cost rise is involved.

SUMMARY OF THE INVENTION

In order to solve the problems, an object of the invention is to provide a connector provided with an electromagnetic shield capable of easily providing an electromagnetic shield layer on the surface of a connector housing with a homogeneous thickness even in the case the connector housing has a complicated structure with many projections and recesses so as to obtain the excellent electromagnetic shield effect as well as capable of reducing the connector cost without increase of the number of the connector components or increase of the weight, and a method of manufacturing the connector and an apparatus used for the method.

In order to achieve the above object, according to the present invention, there is provided a connector comprising:

- a housing body made of graphitizable material having insulation property; and
- a graphitized electromagnetic shield layer formed by irradiating a laser beam onto the surface of the housing body in inert gas atmosphere.

In the connector provided with an electromagnetic shield of the above-mentioned configuration, since the electromagnetic shield layer is produced by graphitization of the surface of the connector housing itself comprising a thermoplastic resin material by the laser beam irradiation, unlike the case of mounting a metal electromagnetic blocking plate as a separate member, there is no risk of increasing the number of components of the connector or increasing the weight.

Moreover, since the above-mentioned electromagnetic shield layer of the connector provided with an electromagnetic shield can be easily provided with a homogeneous thickness on the surface of the connector housing even in the case the connector housing has a complicated structure with many projections and recesses compared with the connector wherein the conductive thin film is formed by application of the electroless plating or the conductive coating on the outer surface of the connector housing or the connector wherein the conductive material powders are introduced into the resin material of the connector housing.

Accordingly, an electromagnetic shield layer with a homogeneous thickness can be provided easily on the surface of a connector housing even in the case the connector housing has a complicated structure with many projections and recesses so as to obtain the excellent electromagnetic shield effect. Furthermore, since the number of the connector components or the weight is not increased, the cost of the connector can be reduced.

Examples of the graphitizable material to be used in the invention include easily graphitizable polymer resin materials such as polypropylene, polyamide, polyvinyl compounds, and polyimide.

Recently, for example, as disclosed in I.E.E.J. Vol. 117-A, No. 6, pp. 638–644 (1997), experiments have been executed for forming a graphitized conductive path along the irradiation locus by irradiating the surface of a film comprising an easily graphitizable polymer resin material such as polyimide and vinyl chloride directly with a laser beam.

According to the article, by irradiating a polyimide captone film (such as a captone film produced by DuPont-Toray Co., Ltd.) with a 10 Hz pulse YAG laser (Spectra-Physics GCR-150: 7 mm beam diameter, 243 mJ energy per 1 pulse, 1,064 nm wavelength, 8 nsec pulse width) in a nitrogen atmosphere for 5 to 90 minutes, a graphitized layer of about 20 $\mu$m thickness was formed in 30 minutes irradiation time, and a graphitized layer of about 30 $\mu$m thickness was formed in 60 minutes irradiation time. The formed conductive path has a 0.6 to 1.3 Ωcm resistivity and the graphitized material is effective for locking the electromagnetic waves.

Preferably, the connector further comprises an insulating material layer formed on the electromagnetic shield layer.

According to the configuration, damage of the electromagnetic shield layer by contact with other substances can be prevented so that the reliability of the shield performance by the electromagnetic shield layer can be improved as well as the durability can be improved.

According to the present invention, there is also provided a method of manufacturing a connector provided with an electromagnetic shield, comprising the steps of:

placing a connector housing made of graphitizable material having insulation property in a room filled with an inert gas; and irradiating a laser beam onto the surface of the housing body to form a graphitized electromagnetic shield layer thereon.

Preferably, the manufacturing method further comprises the step of coating an insulating material layer on the electromagnetic shield layer.

According to the present invention, there is also provided an apparatus for manufacturing a connector provided with an electromagnetic shield comprising:

a transporter for transporting a connector housing made of graphitizable material having insulation property along a predetermined transporting path;

a casing arranged on the transporting path;

an inert gas supplier for filling the casing with an inert gas; and a laser oscillator for irradiating a laser beam onto the surface of the connector housing transported into the casing to form a graphitized electromagnetic shield layer thereon.

Preferably, the manufacturing apparatus further comprises a coating section arranged in the downstream of the casing on the transporting path for coating an insulating material on the electromagnetic shield layer.

Preferably, in order to facilitate the laser beam irradiation for overall surface of the connector housing, the transporter includes a transporting belt and a holder cooperated with the transporting belt for holding the connector housing above the transporting belt in the casing.

In the above configuration, since the electromagnetic shield layer formation is executed as a post treatment with respect to a connector housing produced by a well-known resin formation step and thus it is not concerned with the resin formation step of the connector housing, a high quality electromagnetic shield layer can be provided easily to various kinds of existing connector housings only by adding a step for forming the electromagnetic shield layer and adding an apparatus without the need of improvement of the connector housing resin formation step.

DETAILED DESCRIPTION OF THE PREFERRED EMBODIMENTS

Hereinafter an embodiment of a connector provided with an electromagnetic shield and a method of manufacturing the connector and an apparatus used for the method according to the invention will be explained in detail with reference to the accompanied drawings.

Figure 1:
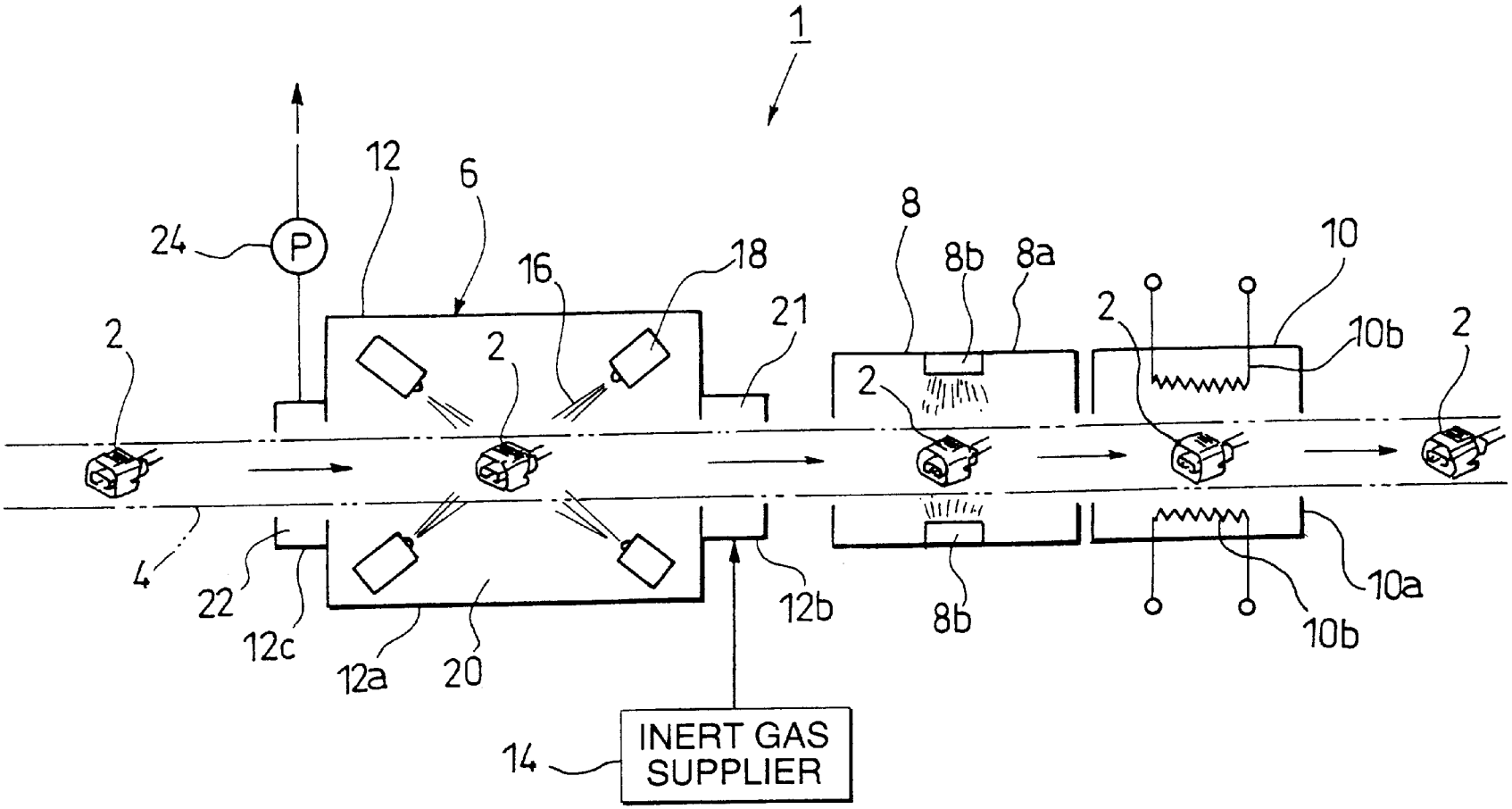
FIG. 1 is a schematic diagram showing an apparatus for manufacturing a connector provided with an electromagnetic shield according to one embodiment of the invention.
Figure 2:
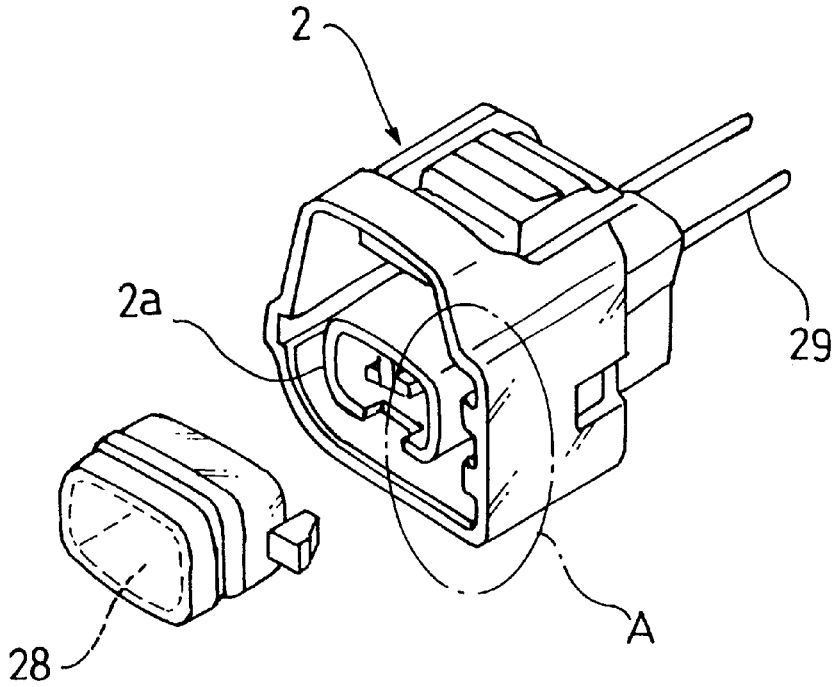
FIG. 2 is a perspective view of the connector.
Figure 3:
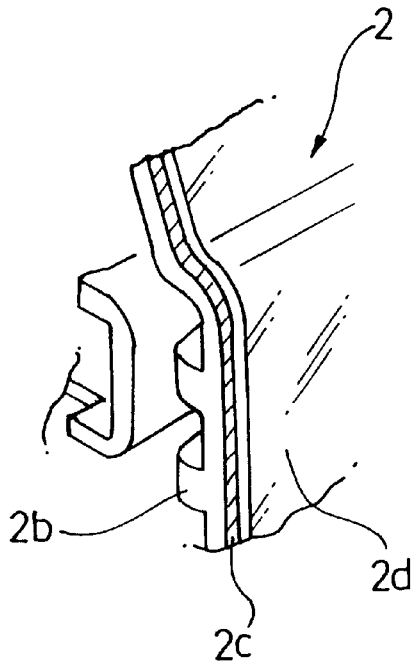
FIG. 3 is an enlarged view of the portion A in FIG. 2.
Figure 4:
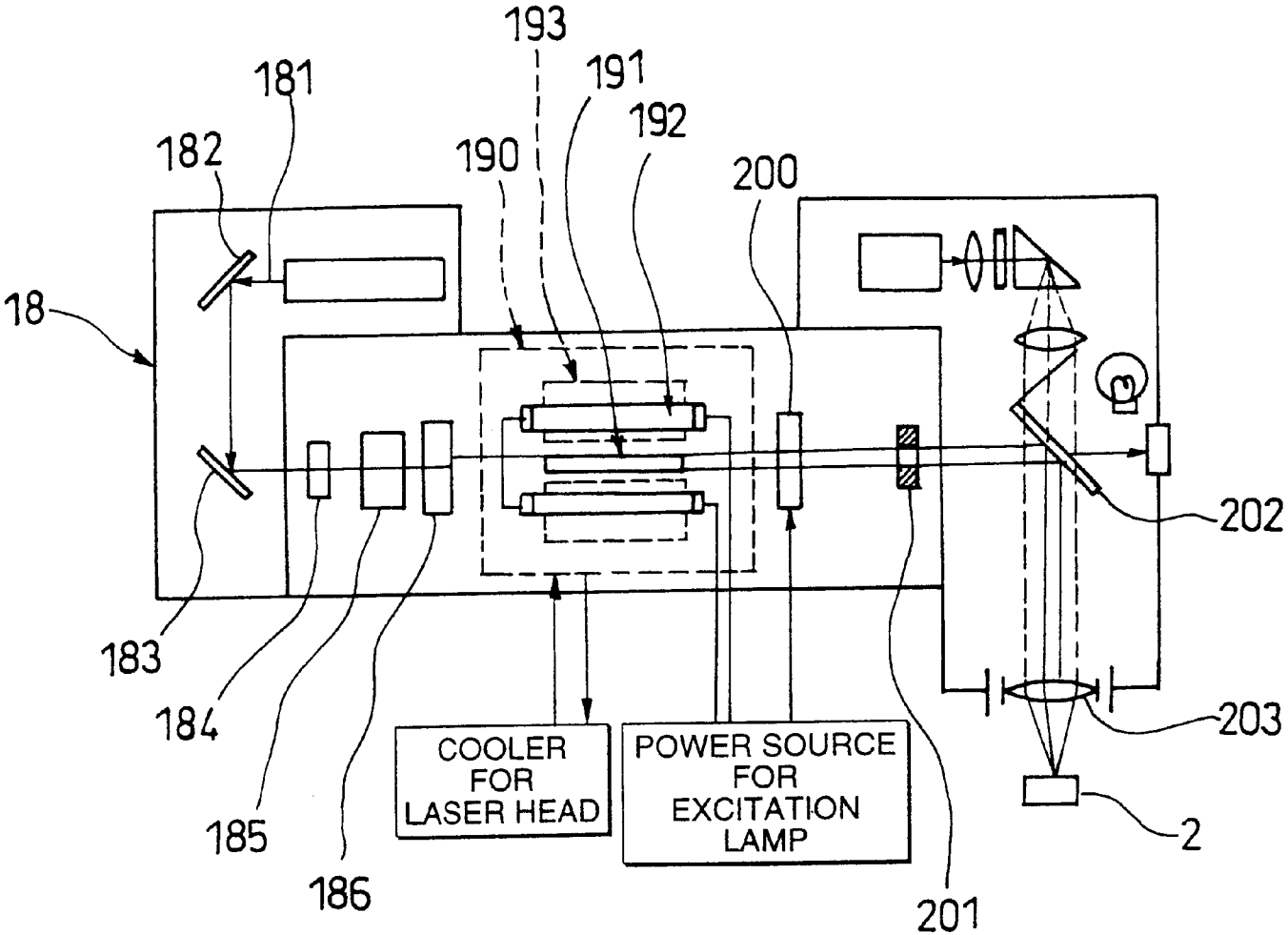
FIG. 4 is a schematic diagram showing a laser oscillator used in the manufacturing apparatus shown in FIG. 1.

FIG. 1 is a schematic diagram an apparatus for manufacturing a connector provided with an electromagnetic shield according to one embodiment of the invention. FIG. 2 is a perspective view of the connector. FIG. 3 is an enlarged view of the portion A in FIG. 2. FIG. 4 is a schematic diagram of a laser oscillator to be used in the manufacturing apparatus shown in FIG. 1.

A manufacturing apparatus I for a connector provided with an electromagnetic shield according to the embodiment comprises a transporter 4 for transporting a connector housing 2 formed with a certain structure by a well-known resin forming step in a certain section, a laser processor 6 disposed in the transporting path of the transporter 4, a coating section 8 disposed in the transporting path of the transporter 4 in the subsequent stage with respect to the laser processor 6, and a coating dryer 10 disposed in the transporting path of the transporter 4 in the subsequent stage with respect to the coating section 8.

As shown in FIG. 2, the connector housing 2 is formed integrally with a certain structure by injection molding of a graphitizable thermoplastic resin material having the insulation property. The connector housing 2 shown in the figure is a female type connector housing comprising a terminal insertion hole 2*a* for accommodating and holding a terminal connected with the tip end of an electric wire for fitting with a male type connector housing (not illustrated) for electric conduction of the terminals.

As the graphitizable thermoplastic resin material, polypropylene, polyamide, polyvinyl compounds, and polyimide can be used as well as other easily graphitizable polymer resin materials can also be used.

The transporter 4 may be a well-known transporting belt. However, it is preferable that a mechanism for holding the connector housing 2 above the transporting belt is provided for facilitating the laser beam irradiation by the laser processor 6 onto the entire periphery of the connector housing 2. As the mechanism for holding the connector housing 2 above the transporting path, for example, a housing holding bracket having a supporting rod for inserting into the terminal insertion hole 2*a* of the connector housing 2 can be provided upright in the transporting path.

The laser processor 6 comprises a processor casing 12 for covering the periphery of the connector housing 2 transported by the transporter 4, an inert gas supplier 14 for providing an inert gas atmosphere as the atmosphere in the processor casing 12, and a laser oscillator 18 for irradiating with a laser beam 16 the surface of the connector housing 2 transported to a certain position in the processor casing 12 by the transporter 4.

The processor casing 12 comprises a main casing 12*a* for providing a processing space 20 in which irradiation of the laser beam 16 is executed, and auxiliary casings 12*b*, 12*c* for forming auxiliary spaces 21, 22 communicating with the processing space 20 in front and rear of the main casing 12*a*.

The inert gas supplier 14 is connected with the auxiliary casing 12*b* for supplying an inert gas such as a nitrogen gas into the processing space 20 via the auxiliary space 21 provided by the auxiliary casing 12*b*. The auxiliary casing 12*c* is connected with a suction pump 24. The suction pump 24 suctions the atmosphere in the processing space 20 via the auxiliary space 22 provided by the auxiliary casing 12*c* for adjusting the inert gas filling state in the processing space 20.

In this embodiment, four sets of the laser oscillator 18 are provided in the processing space 20 provided by the main body casing 12*a*.

The four sets of the laser oscillator 18 in the processing space 20 have different irradiation directions of a laser beam 16 such that the entire region of the outer surface of the connector housing 2 can be irradiated with the laser beam 16 with a homogeneous strength.

As shown in FIG. 2, when the connector housing is irradiated by the laser beam 16 in the laser processor 6, a cover member 28 for covering the terminal insertion hole 2*a* is fitted with an open end of the connector housing 2 in order to preventing a terminal fitting portion thereof from graphitizing.

Moreover, the connector housing 2 executes the process by the manufacturing apparatus 1 in the state without mounting an electric wire with a terminal 29.

In this embodiment, as the laser oscillator 18, an YAG laser oscillator shown in FIG. 4 is used.

In the YAG laser oscillator, a gas laser light 181 for the optical axis alignment is guided to an YAG rod 191 of a laser head 190 via mirrors 182,183, a reflecting mirror 184, a Q switch 185, and a beam shutter 186. In the laser head 190, the output of the YAG rod 191 is controlled by an excitation lamp 192 and an elliptical light gathering mirror 193 so that the laser light outputted form the YAG rod 191 is finished as a laser beam 16 having a predetermined beam diameter via a mode selector 200, an output mirror 201, a dichroic mirror 202 and a condensing lens 203 so as to be directed to the connector housing 2 as a substance to be processed.

As the condensing lens 203, a convex lens, a concave mirror, and a paraboloidal mirror can be used. By optionally selecting the lens or the mirror to be used, the laser beam 16 to be directed to the substance to be processed can be set as a diffusing beam with the beam diameter gradually widened. According to the diffusing beam, efficiency in the irradiation operation for the substance to be processed can be improved.

The coating section 8 comprises a resin jetter 8*b* for the spray application of the resin equivalent to the material resin of the connector housing 2 in a casing 8*a* for covering the transporting path so that an insulator can be coated and formed on the outer surface of the electromagnetic shield layer formed on the connector housing 2 by the process with the laser processor 6.

The coating dryer 10 comprises a resin solidificator 10*b* for drying and solidifying the resin applied on the connector housing 2 in a casing 10*a* for covering the transporting path so that the insulator coated by the coating section 8 can be solidified.

A manufacturing method of a connector provided with an electromagnetic shield according to the invention utilizing the manufacturing apparatus 1 comprises the steps of forming a graphitized electromagnetic shield layer on the outer surface of the connector housing 2 made from a graphitizable material by irradiating the laser beam 16 onto the outer surface of the connector housing 2 in the laser processor 6 filled with an inert gas such as a nitrogen gas, guiding the connector housing 2 applied with the graphitization process and discharged from the laser processor 6 into the coating section 8 for forming an insulator by coating on the outer surface of the graphitized electromagnetic shield layer by the coating section 8, and drying and solidifying by the coating dryer 10 the insulator coated by the coating section 8.

In the connector housing 2 irradiated with the YAG laser by the laser processor 6 of the manufacturing apparatus 1, the surface portion irradiated with the YAG laser is heated locally at an extremely high temperature momentarily. As a result, only volatile components are evaporated from molecular components comprising the skeleton of the polymer resin so that only the carbon component, which is the residual solid component, remains on the surface layer so as to be crystallized and adhered onto the lower resin layer. Consequently, an electromagnetic shield layer comprising graphite is formed on the surface.

As shown in FIG. 3, in the connector housing 2 applied with the process by the laser processor 6, the coating section 8, and the coating dryer 10, an electromagnetic shield layer 2*c* is formed with a homogeneous thickness by the graphitization on the outer surface of the resin outer wall 2*b*, and further, an insulator coat 2*d* is formed with a homogeneous thickness on the outer surface of the electromagnetic shield layer 2*c*.

Since the electromagnetic shield layer 2*c* is produced by graphitization of the surface of the connector housing 2 itself comprising a thermoplastic resin material by the laser beam 16 irradiation, unlike the case of mounting a metal electromagnetic blocking plate as a separate member, there is no risk of increasing the number of components of the connector or increasing the weight.

Moreover, since the above-mentioned electromagnetic shield layer 2*c* can be easily provided with a homogeneous thickness on the surface of the connector housing 2 even in the case the connector housing 2 has a complicated structure with many projections and recesses compared with the connector wherein the conductive thin film is formed by application of the electroless plating or the conductive coating on the outer surface of the connector housing 2 or the connector wherein the conductive material powders are introduced into the resin material of the connector housing 2.

Accordingly, the electromagnetic shield layer 2*c* with a homogeneous thickness can be provided easily on the surface of the connector housing 2 even in the case the connector housing 2 has a complicated structure with many projections and recesses so as to obtain the excellent electromagnetic shield effect. Furthermore, since the number of the connector components or the weight is not increased, the cost of the connector can be reduced.

Moreover, since the insulator coat 2*d* is formed by coating on the outer surface of the electromagnetic shield layer 2*c* in the connector provided with an electromagnetic shield of the above-mentioned embodiment, damage of the electromagnetic shield layer 2*c* by contact with other substances can be prevented so that the reliability of the shield performance by the electromagnetic shield layer 2*c* can be improved as well as the durability can be improved.

Furthermore, since the manufacturing method and apparatus 1 of a connector provided with an electromagnetic shield shown in the above-mentioned embodiment include formation of the electromagnetic shield layer 2*c* by the laser beam 16 irradiation as the post treatment with respect to a connector housing 2 produced by an ordinary resin formation step and thus it is not concerned with the resin formation step of the connector housing 2, a high quality electromagnetic shield layer 2*c* can be provided easily to various kinds of existing connector housings 2 only by adding a step for forming the electromagnetic shield layer 2*c* and adding an apparatus without the need of improvement of the connector housing resin formation step.

The laser for the graphitization process of the resin material used in the invention is not limited to the YAG laser shown in the above-mentioned embodiment but various kinds of lasers such as CO2 laser, excimer laser, other solid lasers or the like can be used as well.

Moreover, the concrete structure of the connector housing is not limited to the structure of the above-mentioned embodiment.

Furthermore, the coating section 8 and the coating dryer 10 can be provided optionally as needed, and thus they may be omitted in the case the insulator coat 2*d* is not required on the outer surface of the electromagnetic shield layer 2*c* depending on the connector installation environment condition.

Although the electromagnetic shield layer 2*c* is formed on the outer surface of the connector housing in the above-mentioned embodiment, the electromagnetic shield layer 2*c* can also be provided on the inner wall for partitioning the inside of the connector housing by the laser beam irradiation for preventing the influence of the internal multiple signals with each other depending on the connector housing structure.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector comprising:

a housing body made of graphitizable material having insulation property; and a graphitized electromagnetic shield layer formed by irradiating a laser beam onto the surface of the housing body in inert gas atmosphere.

2. The connector as set forth in claim 1, further comprising an insulating material layer formed on the electromagnetic shield layer.

3. A method of manufacturing a connector provided with an electromagnetic shield, comprising the steps of:

placing a connector housing made of graphitizable material having insulation property in a room filled with an inert gas; and irradiating a laser beam onto the surface of the housing body to form a graphitized electromagnetic shield layer thereon.

4. The manufacturing method as set forth in claim 3, further comprising the step of coating an insulating material layer on the electromagnetic shield layer.

* * * * *